US008376660B2

(12) United States Patent
Paredes Montecinos

(10) Patent No.: US 8,376,660 B2
(45) Date of Patent: Feb. 19, 2013

(54) MINING MESH WITH DOUBLE KNOT

(75) Inventor: Hector Paredes Montecinos, Talcahuano (CL)

(73) Assignee: NV Bekaert SA, Zwevegem (BE)

( * ) Notice: Subject to any disclaimer, the term of this patent is extended or adjusted under 35 U.S.C. 154(b) by 170 days.

(21) Appl. No.: 12/810,066

(22) PCT Filed: Oct. 29, 2008

(86) PCT No.: PCT/EP2008/064629

§ 371 (c)(1),
(2), (4) Date: Jun. 22, 2010

(87) PCT Pub. No.: WO2009/086960

PCT Pub. Date: Jul. 16, 2009

(65) Prior Publication Data

US 2010/0266350 A1 Oct. 21, 2010

(30) Foreign Application Priority Data

Jan. 4, 2008 (EP) ..... 08150039

(51) Int. Cl.
*E02D 3/02* (2006.01)

(52) U.S. Cl. ..... 405/302.3

(58) Field of Classification Search ..... 405/302.2, 405/302.3, 272, 288; 256/32, 33, 45; 245/2–11; 57/202; 140/104, 114; 87/12, 53; D25/45; 66/172 R; 52/660–676
See application file for complete search history.

(56) References Cited

U.S. PATENT DOCUMENTS

| | | | | | |
|---|---|---|---|---|---|
| 712,212 | A | * | 10/1902 | Swinscoe | 474/239 |
| 1,325,590 | A | * | 12/1919 | Snedeker | 245/6 |
| 1,759,256 | A | * | 5/1930 | Harter | 245/5 |
| 2,888,854 | A | * | 6/1959 | Johnson | 87/12 |
| 3,043,544 | A | * | 7/1962 | Hooper | 245/6 |
| 3,473,652 | A | * | 10/1969 | Verstraete | 242/160.4 |
| 3,512,760 | A | * | 5/1970 | Rohrbacher | 256/32 |
| 3,592,420 | A | * | 7/1971 | Reiter | 245/9 |
| 5,996,972 | A | * | 12/1999 | Kaiser | 256/12.5 |
| 6,279,858 | B1 | * | 8/2001 | Eicher | 245/8 |
| 7,393,060 | B2 | * | 7/2008 | Collins | 299/12 |
| 2004/0140463 | A1 | | 7/2004 | Garcia et al. | |

FOREIGN PATENT DOCUMENTS

| | | | |
|---|---|---|---|
| EP | 0862959 | B1 | 11/2000 |
| EP | 1390592 | B1 | 2/2004 |
| WO | WO 02/097215 | A1 | 12/2002 |

* cited by examiner

*Primary Examiner* — Thomas B Will
*Assistant Examiner* — Patrick Lambe
(74) *Attorney, Agent, or Firm* — Foley & Lardner LLP

(57) ABSTRACT

A mining mesh comprises successive undulated transverse links (1,2,3,4), which are interconnected together at the bent portions of the links, whereby each pair of successive undulated links (1,2), (3,4), . . . forms a row of adjacent rectangular or square meshes (5) having four sides. The mesh is characterised in that at least at one border of the mesh, for each pair of successive links, the last side of the first link (1) is bent upwardly and backwardly over a sharp angle, whereby the end of this last side is hooked around the penultimate (last but one) side of the second link (2) and that the last side of the second link (2) is bent downwardly and backwardly over a sharp angle, whereby the end of this last side is hooked around the penultimate (last but one) side of the first link (1). The advantage is a stronger mining mesh where the overlap between two adjacent rolls can be limited.

8 Claims, 2 Drawing Sheets

MINING MESH WITH DOUBLE KNOT

TECHNICAL FIELD

Figure 1:
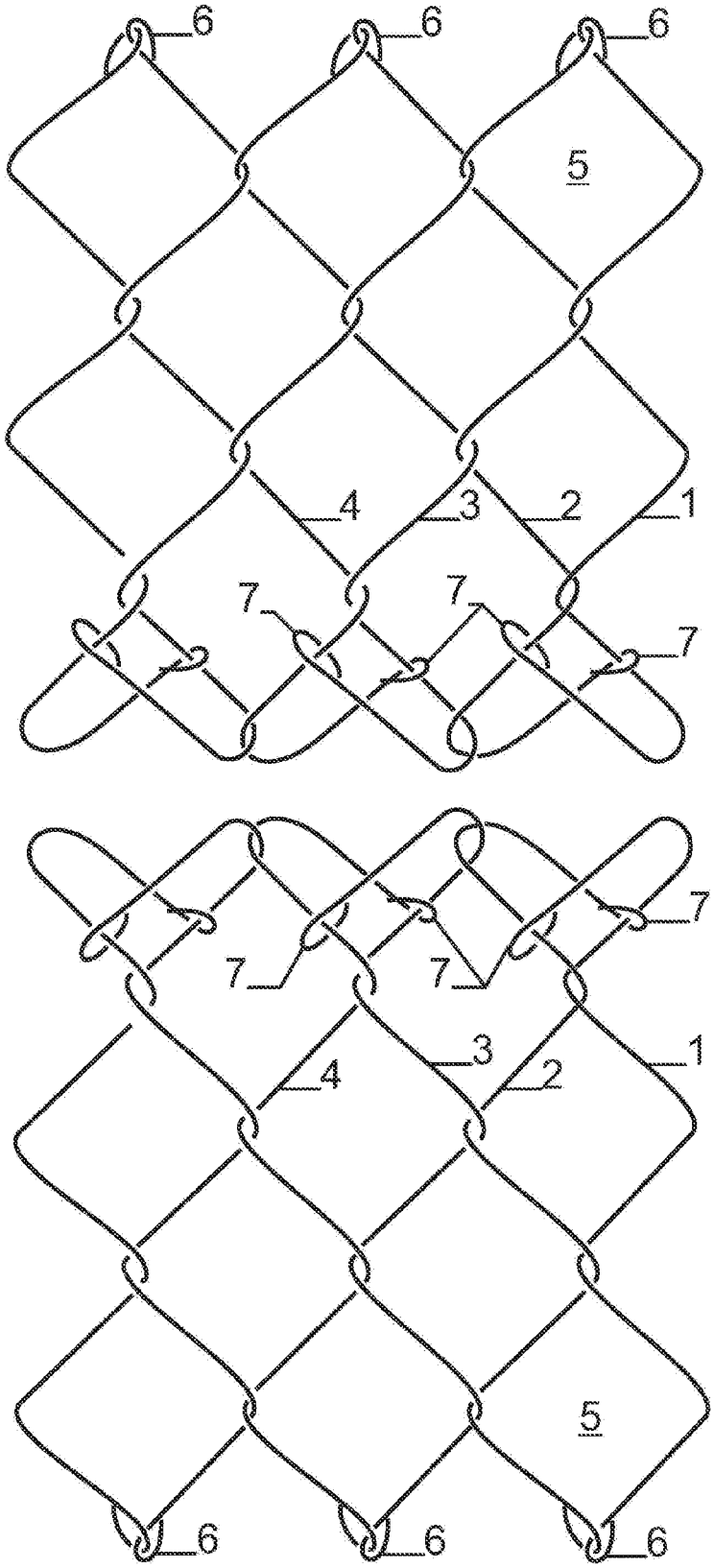

This invention relates to a mining mesh comprising successive undulated transverse links, which are interconnected together at the bent portions of the links, whereby each pair of successive undulated links forms a row of adjacent rectangular or square meshes having four sides.

BACKGROUND ART

Such a mining mesh, which is also known as a chain link woven mesh, is generally used in the mining industry as mining support mesh or in the building industry as tunnelling reinforcing mesh.

It is known to stabilise roof strata of underground mines and tunnels with all types of meshes, such as woven and welded meshes. Such a welded netting mesh for tunnel constructions is e.g. described in the EP-patent no. 1390592 B1 of applicant. A disadvantage of such welded mesh for mining or tunnelling mesh is that it is rather expensive. Another disadvantage is that it is rather stiff or rigid, which can lead to fixing problems when positioning such panels of welded mesh adjacent to each other against the roof strata because these panels do not adapt correctly to the roof strata of the underground mines or tunnels. Yet another disadvantage is that the welded mesh does not support heavy loads due to early failure of the welding points.

It is a.o. for these reasons, that in many cases, woven meshes, such as chain link woven meshes, are preferred and will be used to resist the downward sagging of the roof strata in the mining and tunnelling industry. Such chain link woven meshes are generally known and are e.g. described in the U.S. Pat. Nos. 3,473,652, 3,512,760 and European patent 862959 B1.

Sheets or rolls of such woven meshes need to be placed border by border against the roof strata by means of all kinds of fixing elements, such as bolts, tensioning nuts, bearing plates, . . . . It is also known to apply a concrete layer by means of shot-concrete for fixing the sheets or rolls of woven meshes to the roof of the mine or tunnel.

To obtain a continuous reinforcement by means of sheets or rolls of woven meshes and to avoid e.g. loose rock that otherwise could fall into the mine or tunnel from the roof of the mine or tunnel; it is also necessary to connect the borders of the adjacent sheets or rolls of woven meshes strongly to each other.

A disadvantage of these known chain link woven meshes, when used as reinforcement for the mining or tunnelling industry, is that it is necessary to overlap the two borders of the adjacent sheets or rolls of woven mesh over at least three or four meshes of the sheets or rolls for obtaining a strong closed continuous reinforcement and for avoiding in this way any possible problems with such a reinforcement. It is clear, that this connecting problem of two adjacent sheets or rolls leads to a higher use of reinforcing mesh due to the two overlapping border areas of the two adjacent sheets or rolls of woven mesh.

The basic reason of this need of the overlapping of the two adjacent border areas of the woven meshes is probably due to the fact, that these known chain link meshes at its both borders or edges are provided with standard single knots, which are not closed in a strong way and are therefore easily opened under rather low tensions.

DISCLOSURE OF INVENTION

It is an object of the present invention to provide an improved mining mesh, whereby it is not longer necessary to overlap the two borders of the adjacent sheets or rolls of woven mesh over a distance of several meshes for obtaining a strong closed continuous reinforcement.

It is a further object of the present invention to provide an improved mining mesh having at least one very strong border or selvedge (selvage).

A first embodiment of the mining mesh according to the invention is characterized in, that at least at one border of the mesh, for each pair of successive links, the last side of the first link is bent upwardly and backwardly over a sharp angle, whereby the end of this last side is hooked around the penultimate (last but one) side of the second link and that the last side of the second link is bent downwardly and backwardly over a sharp angle, whereby the end of this last side is hooked around the penultimate (last but one) side of the first link.

A second embodiment of the mining mesh according to the invention is characterized in, that at least at one border of the mesh, for each pair of successive links, the second link is ending with a U-shaped loop, provided with a first noose at the first end of the U-shaped loop and with a second noose at the second end of the U-shaped loop, and that the end of the first link goes through the first noose, the second noose and is finishing with a hook into the first noose forming in this way a closed loop.

A special feature of these two embodiments of the mining mesh according to the invention is the fact, that for each set of two successive links, one standard single knot is now replaced by two special locking knots or by two special locking loops. Thanks to this fact, woven mining meshes with a very strong border or selvedge (selvage) are obtained.

Tests with mining meshes according to the invention have shown that the loss of mesh surface is reduced by at least 10% because it is now sufficient to overlap the border areas of the two adjacent sheets or rolls of mining mesh over only a short distance for creating a continuity between the adjacent sheets or rolls. The result is a complete reinforced roof surface of the mine or tunnel without any weak zones in the overlapping areas.

BRIEF DESCRIPTION OF FIGURES IN THE DRAWINGS

Figure 2:
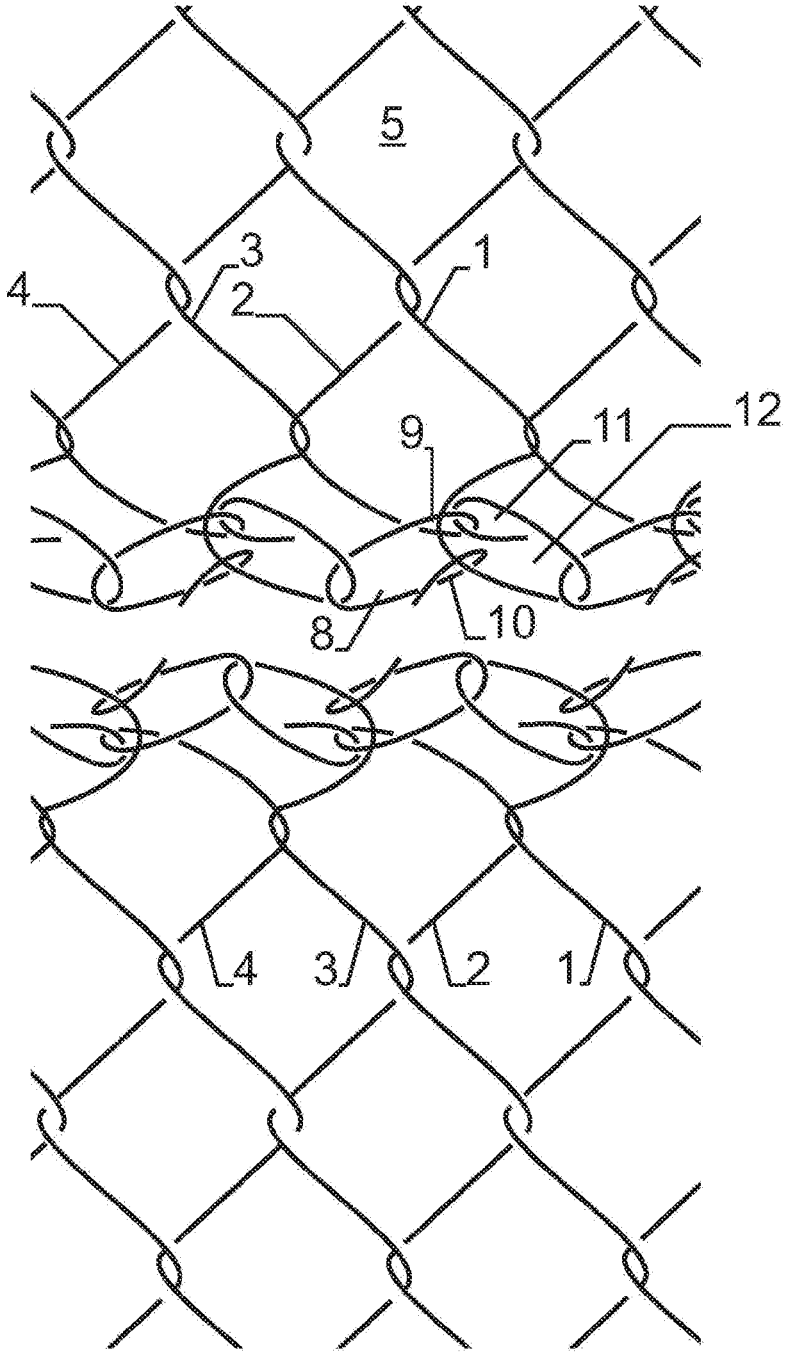

Other objects and advantages of the mining mesh according to the invention will be fully understood from the following description given by way of example with reference to the accompanying drawing in which:

FIG. 1 shows a top view of two adjacent sheets of a first embodiment of mining mesh according to the invention, just before the overlapping operation of the border areas thereof, FIG. 2 shows a top view of two adjacent sheets of a second embodiment of mining mesh according to the invention, just before the overlapping operation of the border areas thereof.

MODE(S) FOR CARRYING OUT THE INVENTION

FIG. 1 shows a top view of two portions of two adjacent sheets of a first embodiment of a woven mining mesh according to the invention, just before the overlapping operation of the border areas thereof. The woven mining meshes comprise successive undulated or zig-zag transverse links 1,2; 3, 4; . . . , which are interconnected or interweaved at the bent portions of the links. Each pair 1,2; 3,4; . . . of successive undulated links forms a row of adjacent rectangular or square meshes 5 having four sides. The straight sides of the meshes 5 between the bent portions may be corrugated. Each link 1,2,3,4, . . . is e.g. formed by wrapping helically a steel wire around a steel bar with a substantially rectangular cross-section. It means that the steel wire has been bent in a zig-zag fashion. Each link or steel wire is threatened across the width of the woven mesh into the previously threaded zig-zag wire link. The steel wires or links may be suitably coated against corrosion. Examples of such meshes are e.g. clearly described in U.S. Pat. Nos. 3,473,652 and 3,512,760.

FIG. 1 shows at the outside borders of the woven mining meshes standard single knots 6. These standard single knots 6 of the woven meshes are formed by hooking the ends of each pair of successive links or wires 1,2; 3,4; . . . around each other. It means that the end of the last or border side of link 1 is bent around the last or border side of link 2 and vice versa.

FIG. 1 shows at the two adjacent or inside borders of the woven mining meshes double locking knots 7 according to the invention. In this case, the last side or border side of the first link 1 is bent upwardly and backwardly over a sharp angle so that the end of this last side is hooked around the penultimate (last but one) side of the second link 2 for forming in this way the first locking knot 7. Further, the last or border side of the second link 2 is bent downwardly and backwardly over a sharp angle, whereby the end of this last side is now hooked around the penultimate (last but one) side of the first link for forming in this way the second locking knot 7.

As can be seen from FIG. 1, the two or double locking knots 7 according to the invention are situated in the formed woven meshes, whereas the standard single knots 6 are situated at the outmost part of the borders of the two woven mining meshes. Moreover, the bent last sides of the links 1,2,3,4, . . . form together a strong border region or selvedge (selvage).

In a preferred embodiment of the invention, each woven mining mesh is at both borders of the mesh provided with the double locking knots according to the invention.

In another preferred embodiment of the woven mining mesh according to the invention, the end of the last side of the first link 1 is hooked substantially in the middle of the penultimate (last but one) side of the second link, whereas the end of the last side of the second link 2 is hooked substantially in the middle of the penultimate (last but one) side of the first link 1.

FIG. 2 shows a top view of two portions of two adjacent sheets of a second embodiment of a woven mining mesh according to the invention, just before the overlapping operation of the border areas thereof. The same reference numbers of FIG. 1 are used in FIG. 2 to denote the same parts or elements of the woven mining mesh according to the invention.

FIG. 2 shows that the two embodiments of the woven mining meshes according to the invention are provided with special locking loops 8 and 12 at the adjacent or inside borders thereof.

For each pair of two successive links 1 and 2; the second link 2 is ending with a U-shaped loop 8. This loop 8 is provided with a first noose 9 at the first end of the U-shaped loop 8 and with a second noose 10 at the second end of the U-shaped loop 8. The end of the first link 1 goes through the first noose 9, the second noose 10 and is finishing with a hook 11 into the first noose 9 for forming in this way a closed loop 12.

As can be seen from FIG. 2, the two locking loops 8 and 12 according to the invention are situated in the formed woven meshes, whereas the standard single knots 6 are situated at the outmost part of the borders of the two woven mining meshes.

In a preferred embodiment of the invention, each woven mining mesh is at both borders of the mesh provided with these two special locking loops 8 and 12.

In another preferred embodiment of the woven mining mesh according to the invention, the U-shaped loop 8 and the closed loop 12 of two successive links 2 and 3 are interconnected or interweaved. All these interlocking loops 8 and 12 form together a strong border region or selvedge (selvage).

The two adjacent or inside borders of the two sheets of mining meshes, shown in FIGS. 1 and 2, can be firmly and easily connected to each other by all kinds of connecting means. It is e.g. possible to overlap only the adjacent borders and to interweave a spiralling connecting wire through these overlapping borders for forming a continuous reinforcement, which is very strong and flexible.

Instead of a spiralling connecting wire, a wire rope or a straight wire can be used to interconnect two sheets or two rolls of mining meshes.

Yet another alternative is to use several pieces of binding wire to connect the two sheets or two rolls of mining meshes.

The invention claimed is:

1. A mining mesh, comprising:

a plurality of successive undulated transverse links having bent portions, which are interconnected together at the bent portions of the links, said plurality of links forming pairs of successive undulated links, wherein each pair of successive undulated links forms a row of adjacent rectangular or square meshes having four sides, wherein a first link and a second link of the plurality of links each have a terminating end with a previous side, a last side, and an end portion adjacent to and bent with respect to the last side, wherein the last side of the first link is bent upwardly and backwardly and substantially parallel to the previous side of the first link, wherein the end portion of the first link is hooked around the previous side of the second link, wherein the last side of the second link is bent downwardly and backwardly and substantially parallel to the previous side of the second link, and wherein the end portion of the second link is hooked around the previous side of the first link.

2. A mining mesh according to claim 1, wherein at both terminating ends of the first link and the second link of the mesh, for each pair of successive links, the last side of the first link is bent upwardly and backwardly and substantially parallel to the previous side of the first link, wherein the end portion of the first link is hooked around the previous side of the second link and the last side of the second link is bent downwardly and backwardly and substantially parallel to the previous side of the second link, and wherein the end portion of the second link is hooked around the previous side of the first link.

3. A mining mesh according to claim 2, wherein the end portion of the first link is hooked substantially in the middle of the previous side of the second link and the end portion of the second link is hooked substantially in the middle of the previous side of the first link.

4. A mining mesh according to claim 1 wherein the end portion of the first link is hooked substantially in the middle of the previous side of the second link and the end portion of the second link is hooked substantially in the middle of the previous side of the first link.

5. A mining mesh, comprising:

a plurality of successive undulated transverse links having bent portions, which are interconnected together at the bent portions of the links, said plurality of links forming a plurality of pairs of successive undulated links, including at least a first pair of links and a second pair of links, wherein each pair of successive undulated links forms a row of adjacent rectangular or square meshes having four sides, wherein the plurality of links forming the plurality of pairs of links each have a terminating end with an end portion, wherein the terminating end of a second link of the first pair ends with a U-shaped loop, said U-shaped loop having a first end and a second end, provided with a first noose at the first end of the U-shaped loop and with a second noose at the second end of the U-shaped loop, and wherein the end portion of a first link of the first pair goes through the first noose and the second noose of the second link of the first pair, and further goes through a U-shaped loop of a second link of the second pair, and finishes with a hook around the first noose of the second link of the first pair to form a closed loop.

6. A mining mesh according to claim 5, wherein at both terminating ends of the plurality of links, for each pair of successive links, the second link of a successive pair of links ends with a U-shaped loop provided with a first noose at the first end of the U-shaped loop and with a second noose at the second end of the U-shaped loop, and the end portion of the first link of the successive pair of links goes through the first noose and the second noose of the second link of the successive pair of links, and further goes through the U-shaped loop of the second link of a neighboring pair of links and finishes with a hook around the first noose of the second link of the successive pair of links to form a closed loop.

7. A mining mesh according to claim 6, wherein the U-shaped loop and the closed loop of two successive pairs of links are interconnected.

8. A mining mesh according to claim 5, wherein the U-shaped loop and the closed loop of two successive pairs of links are interconnected.

* * * * *